US005768666A

United States Patent [19]

Ito et al.

[11] Patent Number: 5,768,666

[45] Date of Patent: Jun. 16, 1998

[54] DEVELOPING APPARATUS COMPRISING EXCESSIVE TONER SEPARATION MEANS

[75] Inventors: Isao Ito; Takeshi Sumikawa; Nobumasa Furuya; Shigehito Ando; Hideaki Tanaka, all of Ashigarakami-gun, Japan

[73] Assignee: Fuji Xerox Co., Ltd., Tokyo, Japan

[21] Appl. No.: 754,778

[22] Filed: Nov. 21, 1996

[30] Foreign Application Priority Data

| | | | |
|---|---|---|---|
| Nov. 27, 1995 | [JP] | Japan | 7-329413 |
| Apr. 12, 1996 | [JP] | Japan | 8-115667 |
| Oct. 18, 1996 | [JP] | Japan | 8-295958 |

[51] Int. Cl.[6] ..... G03G 15/09

[52] U.S. Cl. ..... 399/273; 399/260; 399/261; 399/272

[58] Field of Search ..... 399/30, 222, 259, 399/261, 267, 272, 273, 255, 229, 260; 430/122

[56] References Cited

U.S. PATENT DOCUMENTS

| | | | |
|---|---|---|---|
| 3,572,551 | 3/1971 | Gillespie et al. | 399/30 |
| 3,610,205 | 10/1971 | Rarey et al. | 399/30 |
| 4,044,719 | 8/1977 | Ohmori | 399/255 |
| 4,418,643 | 12/1983 | Barto, Jr. et al. | 399/261 |
| 4,496,240 | 1/1985 | Yamashita et al. | 399/260 X |
| 4,746,952 | 5/1988 | Kusuda et al. | 399/229 |
| 5,019,870 | 5/1991 | Bares | 399/272 X |
| 5,177,323 | 1/1993 | Kohyama | 399/222 |
| 5,477,307 | 12/1995 | Bergen et al. | 399/260 |
| 5,523,533 | 6/1996 | Itoh et al. | 399/272 |

FOREIGN PATENT DOCUMENTS

| | | |
|---|---|---|
| A-52-15334 | 2/1977 | Japan . |
| 59-55463 | 3/1984 | Japan . |
| B2-5-59427 | 8/1993 | Japan . |
| A-7-84456 | 3/1995 | Japan . |

*Primary Examiner*—Arthur T. Grimley
*Assistant Examiner*—Sophia S. Chen
*Attorney, Agent, or Firm*—Oliff & Berridge, PLC

[57] ABSTRACT

A developing apparatus uses a dual-component developer containing a magnetic carrier and toner electrically attracted to the magnetic carrier for selectively transferring the toner to an electrostatic latent image formed on an image support for visualizing the latent image. The developing apparatus includes a developer transport member facing the image support and having a peripheral surface for supporting and transporting the developer. A toner excess supplying member supplies excess toner to the developer supported on the developer transport member. An excess toner separator separates toner having a small adhesion force to the carrier from the developer to which excessive toner is applied.

17 Claims, 15 Drawing Sheets

DEVELOPING APPARATUS COMPRISING EXCESSIVE TONER SEPARATION MEANS

BACKGROUND OF THE INVENTION

This invention relates to a developing apparatus which uses a dual-component developer containing a magnetic carrier and toner electrically attracted to the magnetic carrier and selectively transfers toner in the dual-component developer to a latent image formed on an image support for visualizing the latent image.

In electrophotographic techniques, a developing method using a dual-component developer containing toner and a magnetic carrier has the advantages that toner is easily charged and that flocculation of toner particles is hard to occur. Thus, hitherto, the method has been widely used although it requires control of the toner amount contained in the dual-component developer, namely, the toner density.

FIG. 15 is a schematic diagram to show the configuration of an example of a conventionally known developing apparatus using a dual-component developer.

The developing apparatus comprises a developing roll 202 placed near and facing an image support 201 for magnetically attracting a developer and transporting it, a developer regulation member 203 for regulating the developer amount attracted on the developing roll 202 as an almost uniform magnetic brush, a paddle 204 for supplying the developer to the developing roll 202, and two augers 205 and 206 for transporting and agitating the developer in a housing 210.

The developing roll 202 comprises a magnet roll 211 fixedly supported and a cylindrical sleeve 212 rotated in the surroundings of the magnetic roll for attracting a developer on the sleeve by the magnetic roll 211 and transporting the developer to a section opposed to the image support 201 by rotating the sleeve 212.

The two augers 205 and 206 rotate so as to transport a developer in opposite directions in two agitation chambers disposed behind the developing roll 202 for circulating the developer in the two agitation chambers communicating with each other at both ends.

In the developing apparatus, the carrier and toner contained in a developer are sufficiently agitated in the agitation chambers 207 and 208 and a part of the developer is supplied to the developing roll 202. The developer is attracted on the sleeve 212 by a pick-up magnetic pole 213 of the magnet roll 211 and its layer thickness is regulated by the developer regulation member 203, then the developer is transported to a developing area for development.

The developer passing through the developing area is released from the sleeve 212 by a pick-off magnetic pole 214 and is restored to the agitation chamber by the paddle 204. In the agitation chamber, the restored developer is mixed with the remaining developer and new toner replenished and is sufficiently agitated.

The charge amount of toner in a developer used with the developing apparatus varies depending on the environmental conditions and also varies greatly depending on the toner concentration in the developer. FIG. 16 shows the relationship between the toner density and toner charge amount in the developing apparatus using a dual-component developer as described above under environmental conditions of high temperature, high humidity, medium temperature, medium humidity, low temperature and low humidity. Generally, the toner charge amount changes according to characteristics as shown in FIG. 16; the toner charge amount must be maintained constant to provide a constant developing characteristic under each environmental condition. To hold the toner charge amount constant, the following control needs to be performed:

When the operating environment changes from high temperature and humidity (state indicated by character w in FIG. 16) to medium temperature and humidity (state indicated by character x' in FIG. 16), toner must be replenished for raising the toner density from W to X to set a state in which the toner charge amount becomes a predetermined value (state indicated by character x' in the figure). When the environmental condition changes from low temperature and humidity (state indicated by character y in FIG. 16) to medium temperature and humidity (state indicated by character z in FIG. 16), the toner density must be lowered from Y to X for setting a state in which the toner charge amount becomes a predetermined value (state indicated by character x in the figure). However, the conventional developing apparatus using a dual-component developer simply consumes toner as means for lowering the toner density, in which case, the toner charge amount lessens and the image density lowers To control the toner density, a reference image is actually developed and its density is sensed for replenishing toner in response to the sensed density; a complicated control method and apparatus are required. From these circumstances, a developing apparatus with a simple mechanism for controlling the toner density for providing a stable-density image is described in the Unexamined Japanese Patent Application Publication No. Sho. 52-15334, the Examined Japanese Patent Application Publication No. Hei. 5-59427, and the Unexamined Japanese Patent Application Publication No. Hei. 7-84456, for example.

In the technique described in the Unexamined Japanese Patent Application Publication No. Sho. 52-15334, a used developer is recovered in a storage tank, which is replenished with a sufficient amount of toner, then the mixture is agitated and charged. Excessive toner particles are removed and the developer is taken out with toner particles adhering to carrier in a saturation state, and is again transported to the developing apparatus for development.

In the technique described in the Examined Japanese Patent Application Publication No. Hei. 5-59427, the point of a magnetic brush on a sleeve is scrubbed with toner in a toner hopper through a mesh screen, whereby the adhesion amount of toner to a magnetic carrier is made stable.

In the technique described in the Unexamined Japanese Patent Application Publication No. Hei. 7-84456, a developing roller is surrounded by a narrow space and the carrier amount in the space is made almost constant, whereby the amount of toner stored in the remaining space is adjusted for controlling the toner density to an almost constant value.

However, the developing apparatuses as described above involve the following problems:

The developing apparatus described in the Unexamined Japanese Patent Application Publication No. Sho. 52-15334, which agitates a developer mechanically, has the disadvantage that a large stress is imposed on the developer, causing toner fusion to the carrier and adhesion of an external additive to toner. Further, the developer is once moved to the storage tank where it is agitated, thus upsizing the apparatus is inevitable and manufacturing costs also increase.

The developing apparatus described in the Examined Japanese Patent Application Publication No. Hei. 5-59427 scrubs a developer through the mesh screen, thus a stress is imposed on the developer, resulting in drastic lowering of the lifespan of the developer. Since the flow property of toner or the charge property of toner, namely, adhesion force of toner and carrier contribute largely to control of the toner density, if the flow property or charge property of toner changes depending on the environment or over time, the toner density control range is placed out of the initially setup range and the print image quality becomes different from the initial one.

Application where solid images having gradation, such as photos, pictures, or maps, are mainly printed and application where line images are mainly printed differ largely in replenished toner amount; since the contract area between carrier and toner is limited in the mesh screen method, when the replenished toner amount largely changes, it becomes difficult to maintain the toner density constant.

Further, the developer is replenished with toner with the magnetic brush formed on the magnet roll; normally the developer is in a flocculation state, thus the effective charge area of carrier decreases and charge-failure toner becomes prone to occur.

The technique described in the Unexamined Japanese Patent Application Publication No. Hei. 7-84456, which uses magnetic toner, requires that magnetic power be contained in toner; magnetic power cannot be mixed with color toner from the coloring property problem and color toner cannot be used. If an attempt is made to non-magnetize toner with importance attached to the coloring property, the disclosed technique does not provide the developing apparatus function. That is, if nonmagnetic toner is used with the developing apparatus, nonmagnetic toner and magnetic carrier are not agitated and are stored in a narrow space, thus toner is charged insufficiently. The toner, which is free of a scatter prevention effect of a magnetic force, easily becomes a cloud; a large amount of toner cloud appears on an image as fog and prints of a good image quality cannot be provided.

SUMMARY OF THE INVENTION

It is therefore an object of the invention to provide a developing apparatus that can control the toner density and toner charge amount in a dual-component developer by a simply structure and provide a good image quality stably even if the toner use amount changes when the environmental conditions change or due to the original document difference.

To the end, according to the invention, there is provided a developing apparatus using a dual-component developer containing a magnetic carrier and toner electrically attracted to the magnetic carrier for selectively transferring the toner to an electrostatic latent image formed on an image support for visualizing the latent image, wherein an excess of toner is supplied to the developer passing through a developing area and then recovered from a developer transport member, then toner having a small adhesion force to the carrier is separated from the developer by excessive toner separation means. The developer from which the excessive toner is separated is again supplied to the developing area.

In the developing apparatus, when toner is supplied excessively and is agitated, it is charged. Then, excessive toner having a small adhesion force to the carrier is separated from the developer by the excessive toner separation means.

The carrier charge amount at this time becomes almost constant independently of environmental conditions and the average charge amount of toner particles adhering to the carrier and the toner amount also become constant. That is, the toner density and the toner charge amount of the developer from which the excessive toner is separated become almost constant. The developer is supported on the developer transport member and transported for development, whereby a stable-density image can be formed even if the environmental conditions change.

The excessive state of toner is a state in which the developer contains toner exceeding a toner density enough to execute proper developing in the developing area.

The cause indicating environmental resistance as described above is guessed as follows: Noting the carrier and toner charge properties, the toner charge property can show stronger environmental dependency than the carrier charge property, because the probability that a chain with a cut polymer exists on the toner surface because of the toner manufacturing method is high, and the cut chain, which is active, easily reacts with water and is prone to undergo environmental change. On the other hand, the carrier usually is coated with a coating material and thus is hard to undergo environmental change unlike the toner. Therefore, in the conventional system, the developer contains a small amount of toner and the charge amount of the developer is in an unsaturation state for the carrier charge capability, thus the toner charge property becomes predominant and environmental dependency is shown. However, in the system of the invention, an excess of toner is supplied to a developer, then excessive toner is separated from the developer. Since the charge amount of the developer becomes a saturation state for the carrier charge capability, the carrier charge property becomes predominant and environmental dependency is not shown.

In the developing apparatus according to the invention, the area in which an excess of toner is supplied to the developer and agitated is set to a position where a magnetic force little acts and magnetic carriers do not form a sequence, whereby the desirable result is provided. That is, toner is supplied and agitated in the area in which a magnetic force little acts as described above, whereby carrier particles disperse and all the surface area comes in contact with the toner, promoting charging the toner. The toner is electrically attracted on all the surface area. Therefore, a developer with toner attracted on the carrier in an electric saturation amount can be supplied stably for development.

On the other hand, a toner excess supplying member is disposed at a position along the outer peripheral surface of a sleeve and a plurality of magnetic poles are disposed in a portion of a magnetic field generation member opposed to the toner excess supplying member as an alternating pattern of N and S poles, whereby excessively supplied toner can also be sufficiently agitated and charged. The developer having the top to which an excess of toner is supplied in the toner excess supplying member forms a magnetic brush as an ear on the sleeve by a magnetic force of the magnetic field generation section and is transported by rotation of the sleeve. At this time, since the magnetic poles in the portion of the magnetic field generation member opposed to the toner excess supplying member form an alternating pattern of N and S poles in the circumferential direction, the magnetic brush tumbles in the direction of the magnetic force line on the sleeve and rotation of the magnetic brush by which the upper developer portion moves to the lower part and the lower developer portion moves to the upper part, or so-called tumbling occurs. Thus, excessively supplied toner is taken into the developer inside and sufficiently agitated.

In the developing apparatus, for example, a sieve member provided with a large number of openings each sized for blocking the magnetic carrier and allowing toner to pass therethrough can be used as the excessive toner separation means. If such a sieve member is used, the developer to which an excess of toner is supplied and which is agitated passes through the top of the sieve member, toner having a small adhesion force to the carrier passes through the openings of the sieve member and excessive toner in the developer is separated. At this time, with furthermore charging, the developer has toner adhering to carrier in a amount for entering a saturation state corresponding to carrier charges.

The sieve member may be shaken mechanically or electrically or the developer on the sieve member may be shaked, whereby separation of excessive toner is promoted and a developer stable in toner density can be provided reliably.

As another example, the excessive toner separation means may have magnetic field generation means with an alternating pattern of N and S poles magnetized along the outer peripheral surface, and a sleeve having a peripheral surface supported for circumferential rotation outside the magnetic field generation means for magnetically attracting the developer on the peripheral surface and transporting the developer. In the excessive toner separation means, a magnetic brush of a developer with an ear of magnetic carriers is transported while tumbling is generated by a circumferential rotation move of the sleeve or rotation of the magnetic field generation means. Toner having a small adhesion force to the carrier is separated by agitation of the tumbling.

As still another example, the excessive toner separation means may have magnetic field generation means for generating a changing magnetic field in the housing of the developing apparatus for agitating and pulling up a developer by a magnetic force and supplying the developer to the developer transport member. For example, the magnetic field generation means may be a magnet supported for rotation behind the wall face of the housing for storing the developer. That is, as the magnet rotates, magnetic poles move, generating a changing magnetic field, whereby the developer in the developing apparatus can be pulled up and toner having a small adhesion force to the carrier is separated from the developer, whereby a developer almost stable in the toner density and toner charge amount can be supplied to the developer transport member; even if the environmental conditions change, a stable-density image can be provided.

Preferably, the magnet supported for rotation is a roll member with an alternating pattern of S and N poles magnetized on the peripheral surface.

As another example, the magnetic field generation means may be a plurality of electromagnets arranged along the wall face of the housing. That is, the current direction and timing are controlled for energizing the electromagnets, whereby a changing magnetic filed can be generated for pulling up the developer in the developing apparatus. Excessive toner can be separated from the developer and supplied to the developer transport member.

The developing apparatus may further include a toner resupply member for transporting the toner separated by the excessive toner separation means to the toner excess supplying member, whereby the separated toner can be recycled smoothly.

The invention is not limited to a dual-component magnetic brush developing apparatus and can also be applied to a so-called hybrid developing apparatus using a dual-component developer and causing a developing area only to function as mono component developing.

DETAILED DESCRIPTION OF THE PREFERRED EMBODIMENTS

Referring now to the accompanying drawings, there are shown preferred embodiments of the invention.

Figure 1:
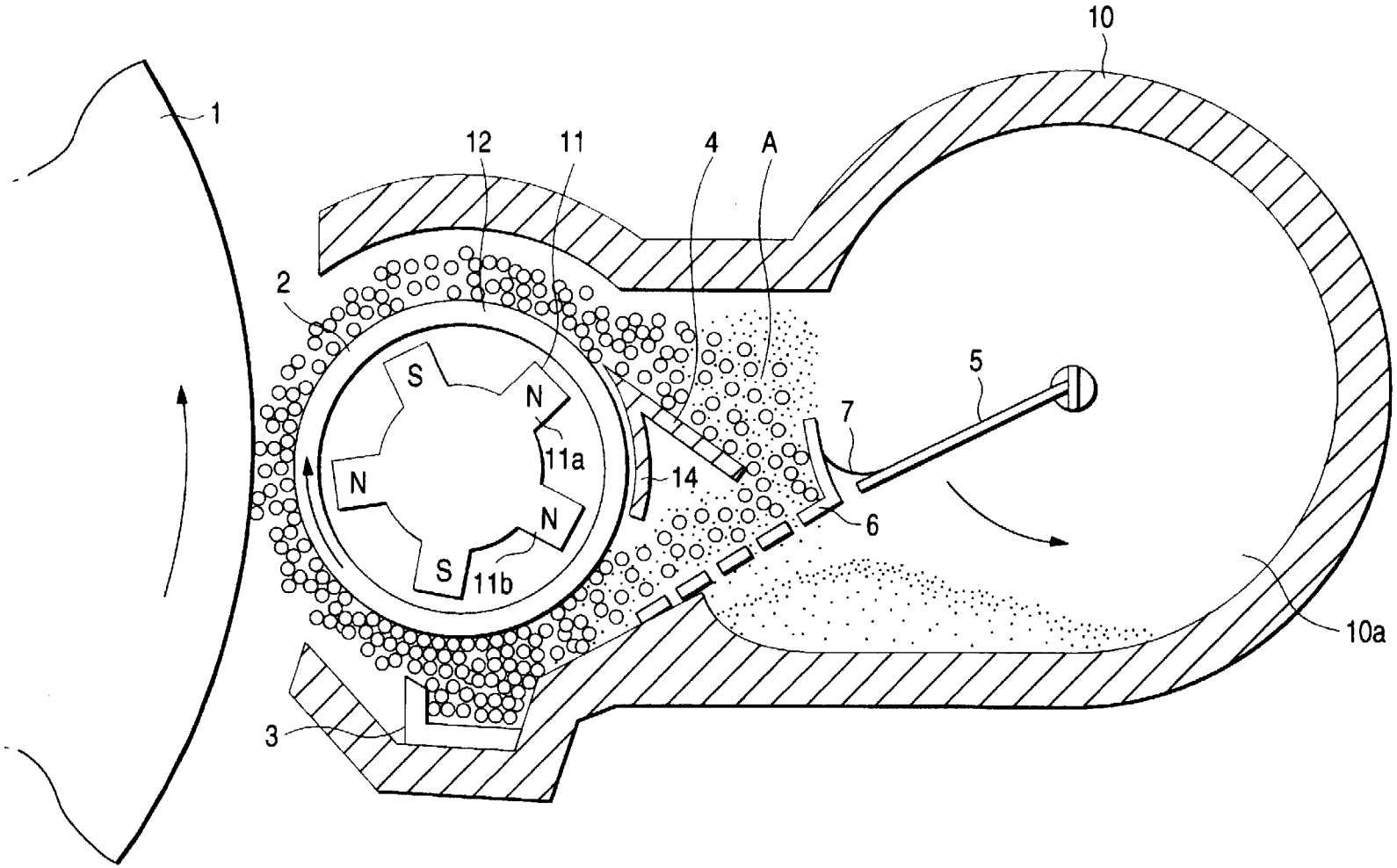
FIG. 1 is a schematic diagram to show the configuration of a developing apparatus of one embodiment of the invention.

FIG. 1 is a schematic diagram to show the configuration of a developing apparatus of one embodiment of the invention.

The development apparatus has a developing roll 2 being placed in a housing 10 for storing a dual-component developer for supporting the dual-component developer on the peripheral surface of the developing roll 2 and transporting the developer to an area opposed to an image support 1, a developer regulation member 3 for regulating the amount of the dual-component developer supported on the developing roll 2, a guide plate 4 for recovering the developer passing through a developing area and then stripped off from the developing roll 2 to a toner excess supplying member A, a paddle 5 for supplying toner to the toner excess supplying member A, and a mesh member (sieve member) for sifting excessive toner from the developer in the lower part of the toner excess supplying member A. Further, a toner box (not shown) for replenishing the housing 10 with toner is linked to the axial end of a toner storage section 10*a* provided with the paddle 5.

The developing roll 2 comprises a magnetic field generation member 11 having a plurality of magnetic poles in the circumferential direction and a hollow cylindrical sleeve 12 supported on the outside of the magnetic field generation member 11 for circumferential rotation. The magnetic field generation member 11 forms a magnetic brush of a dual-component developer on the surface of the sleeve 12 by a magnetic field formed between the adjacent magnetic poles. As the sleeve 12 rotates, the magnetic brush can be transported to the developing area.

Magnetic poles 11*a* and 11*b* of the same polarity in the magnetic field generation member 11 are disposed at adjacent positions and a developer stripped off from the developing roll 2 by a repulsion magnetic filed of the two magnetic poles slips down along the guide plate 4 by gravitation. The surface of the guide plate 4 is coated with fluororesin to make the developer smoothly slip down or a carrier coat agent to accelerate start-up when toner is charged. The developer slipping down along the guide plate 4 is transported to an area not affected by the magnetic force of the magnetic field generation member 11; the area forms the toner excess supplying member A. A partition plate 14 is attached to the guide plate 4 in the proximity of the developing roll 2 for preventing a toner cloud occurring due to toner replenishment or separation from being deposited on the developing roll 2.

The mesh member 6 has a large number of openings of the size for blocking a carrier and allowing toner to pass therethrough; in the embodiment, each opening is set to the size of about 30 μm because the carrier diameter is 50 μm and the toner diameter is 7 μm. The mesh member 6 is disposed so as to incline in the direction of the developing roll 2 for receiving the developer slipping down along the guide plate 4 and allowing the developer to slip down on the mesh member 6 by gravitation.

The paddle 5, which is disposed in the toner storage section 10*a* in the housing 10, rotates in the arrow direction shown in FIG. 1, thereby sufficiently agitating toner and supplying an excess of toner to the toner excess supplying member A. A film member 7 coming in contact with the mesh member 6 at the rotation time is bonded to the tip of the paddle 5 for shaking the mesh member 6 as the paddle 5 rotates. The film member 7 uses a PET film 50 μm thick, but material, etc., of the film member 7 is not limited if the member shakes the mesh member 6.

The toner storage section 10*a* communicates with the lower part of the mesh member 6 and toner passing through the mesh member 6 is restored to the toner storage section 10*a*.

The dual-component developer used with the developing apparatus of the embodiment is a mixture of nonmagnetic polyester family toner and a ferrite family magnetic carrier, but toner or a carrier made of any other material can also be used.

In the developing apparatus, the developer, after it is supported on the developing roll 2 and passes through the developing area, is stripped off from the developing roll 2 by the action of the magnetic poles 11*a* and 11*b* of the same polarity. The stripped-off developer slips down along the guide plate 4 by gravitation and is guided to the toner excess supplying member A. As the paddle 5 rotates, an excess of new toner is supplied to the developer for temporarily raising the toner density in the developer. The value of this toner density, which slightly changes depending on the specific gravity of the carrier and toner used, lies mostly in the range of 20 wt % to 30 wt %. That is, since the normal toner density is 2% to 10% or so when a ferrite family carrier is contained in the developer, or is 6% to 20% when an MT family carrier is contained, the toner density when an excess of toner is supplied corresponds to twice to 15 the general toner density.

The developer is moved to the mesh member 6 by gravitation. It slips down along the slope of the mesh member 6 by gravitation. As the mesh member 6 comes in contact with the film member 7 and is shaken, excessive toner in the developer is screened through the openings into the toner storage section 10*a*. At this time, in the developer, only toner coming in contact with the carrier and charged is held and redundant toner not charged is screened out through the openings, whereby redundant toner having a small charge amount is removed from the developer whose toner density is raised in the toner excess supplying member A, resulting in the toner density corresponding to the carrier charge capability.

Then, the developer is transported to the position opposed to the developing roll 2 and a magnetic brush of the dual-component developer is formed on the developing roll 2. The developer is transported by circumferential rotation of the sleeve 12 and the height of the point of the magnetic brush is regulated by the developer regulation member 3, then the developer is transported to the developing area. Toner in the magnetic brush is transferred to a latent image on the image support 1 by an electric field formed in the developing area. The magnetic brush passing through the developing area is then stripped off from the developing roll 2 and again undergoes the above-mentioned process.

On the other hand, the toner passing through the mesh member 6 in the process is raked out by the paddle 5 and is restored to the toner storage section 10*a*. As the paddle 5 rotates, the toner is sufficiently agitated and is again supplied to the developer in the toner excess supplying member A as supply toner.

Although the developing apparatus has the toner box linked to the toner storage section 10*a* for replenishing the toner storage section 10*a* with toner, the toner storage section 10*a* itself may be a replaceable toner cartridge.

A roller and a brush member may be disposed in place of the guide plate 4 and the partition plate 14, whereby the developer can be easily stripped off from the developing roll. Further, as the members rotate, the developer and the mesh member can also be shaken reliably.

Figure 2:
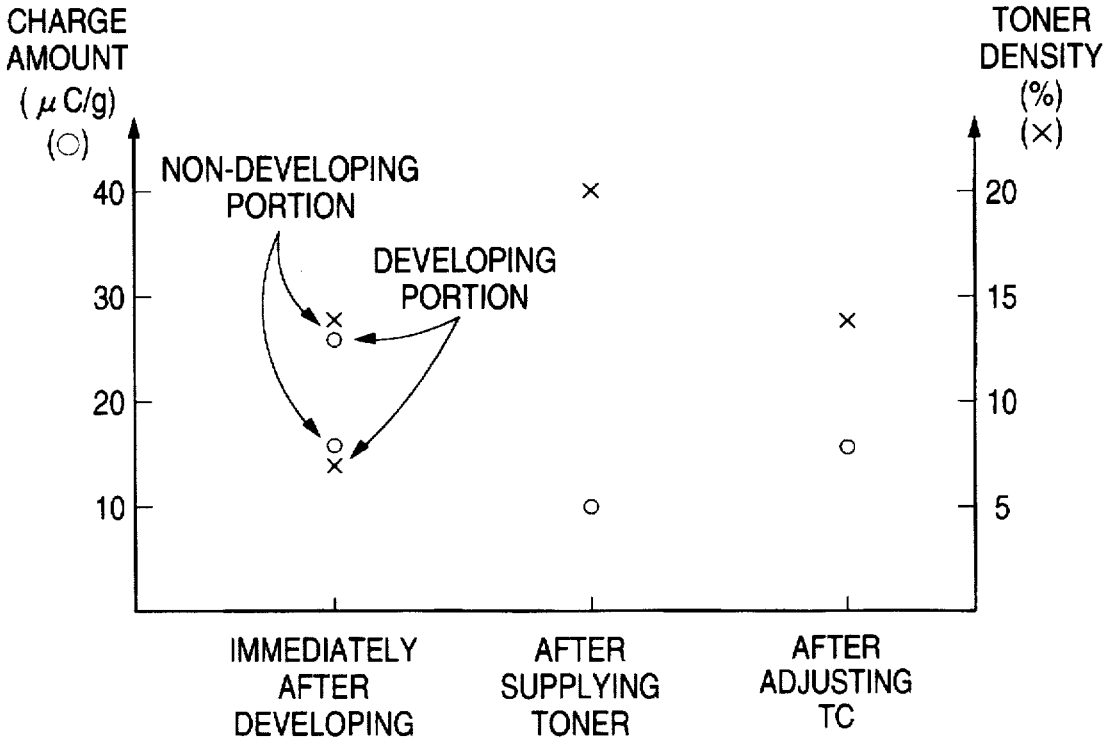
FIG. 2 is an illustration to show the toner density and the toner charge amount in steps of the developing apparatus.

FIG. 2 is an illustration to show change of the toner density and the toner charge amount as the above-mentioned process is executed.

According to the illustration, it is seen that the charge amount and the toner density become almost constant values by executing the process as described above no matter how much the toner charge amount is regardless of the developing or non-developing portion before the toner density is set to a comparatively high density. It is guessed that the process of separating redundant toner from the state in which the toner density is high results in a state in which the carrier can hold toner reasonably, namely, the toner density fitted to the charge capability of the carrier coming in contact with toner and charged. That is, since the carrier is released from the point of the magnetic brush in an area not affected by the magnetic force of the magnetic field generation member 11, the carrier can move comparatively freely and the surface area of the carrier increases; the number of times the carrier comes in contact with toner increases. Thus, the state in which the toner density is high can be easily created and redundant toner is also screened out smoothly; the state in which the carrier can hold toner reasonably can be created.

Figure 3:
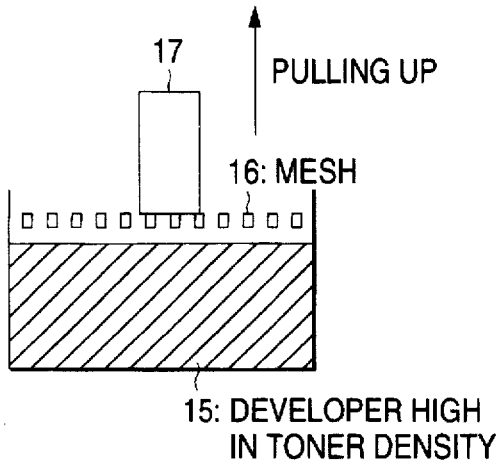
FIG. 3 is an illustration to show an experiment for checking the charge effect of toner when excessive toner is separated from a developer containing an excess of toner.

Next, to examine the charge effect of toner when passing through the mesh member, the charge state was checked using an apparatus as shown in FIG. 3. In the apparatus, a developer 20 high in toner density is stored in a tray 15 and a bar magnet 17 is made to approach the developer via an opening member 16 having a large number of openings through which a magnetic carrier can pass narrowly for pulling up the developer. Resultantly, when the developer passes through the opening member 16, the toner is charged and the pulled-up developer contain almost constant charge amount and toner density. Thus, the developing apparatus can produce a good charge effect even with a small amount of developer and apparatus downsizing is enabled.

Figure 4:
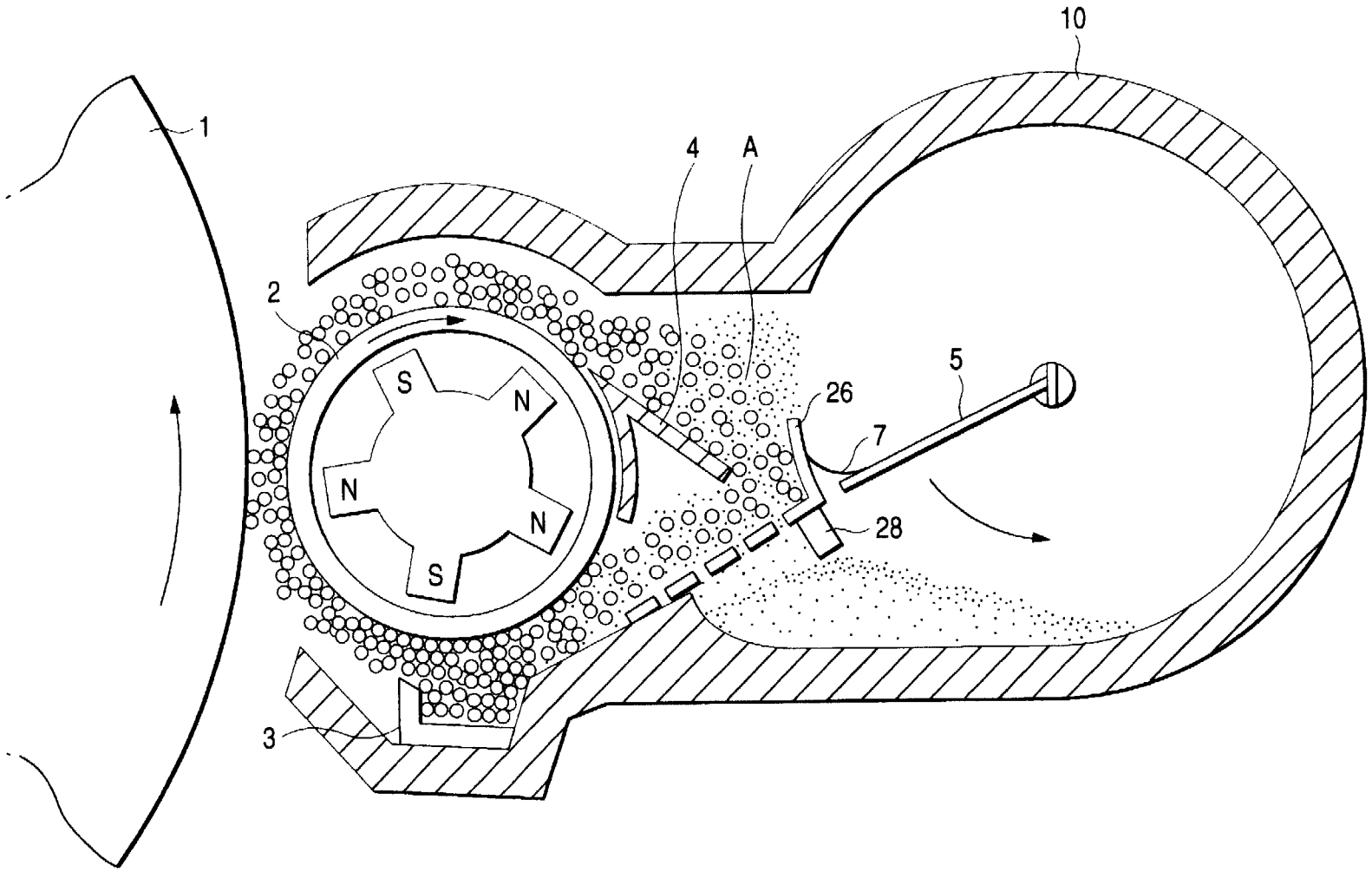
FIG. 4 is a schematic diagram to show the configuration of a developing apparatus of another embodiment of the invention.

FIG. 4 is a schematic diagram to show the configuration of a developing apparatus of another embodiment of the invention.

The developing apparatus further includes a shaking member 28 supported so as to come in contact with a mesh member 26 in addition to the developing apparatus shown in FIG. 1. The shaking member 28 mechanically shakes the mesh member 26 by a motor; it can shake the mesh member 26 little by little. The developing apparatus is the same as that shown in FIG. 1 in other components.

The developing apparatus can smoothly screen out toner having a small adhesion force to a carrier from a developer by shaking the mesh member 26. Thus, the sieve effect when excessive toner is separated improves.

Figure 5:
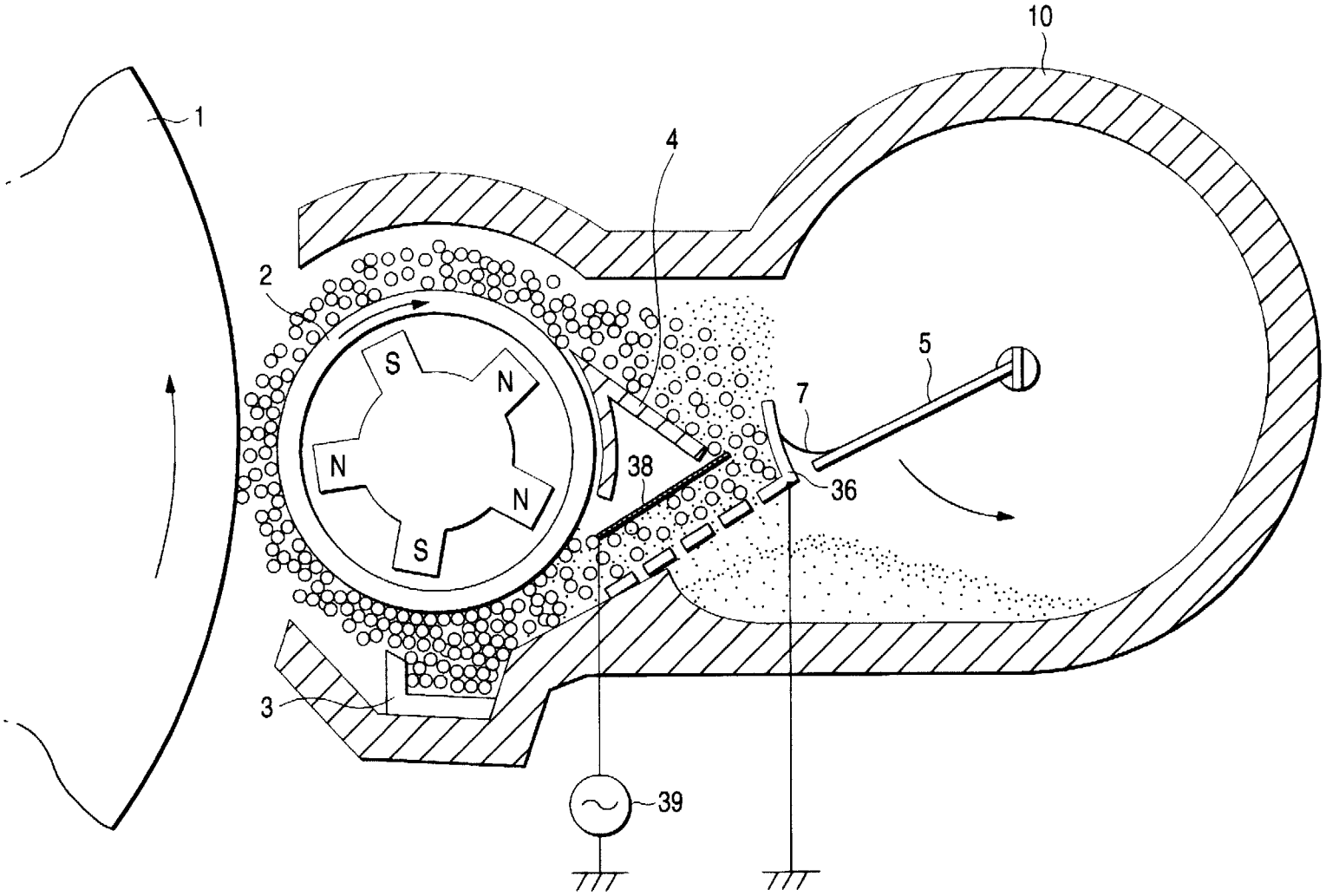
FIG. 5 is a schematic diagram to show the configuration of a developing apparatus of one embodiment of the invention.

FIG. 5 is a schematic diagram to show the configuration of a developing apparatus of one embodiment of the invention.

The developing apparatus has a plate-like electrode member 38 opposed to and above a mesh member 36 and an AC power supply 39 is connected to the electrode member 38. The mesh member 36 is formed of a conductive material and is electrically grounded. The developing apparatus is the same as that shown in FIG. 1 in other components.

In the developing apparatus, an AC voltage applied from the AC power supply 39 causes an electric field to be formed between the electrode member 38 and the mesh member 36, and the mesh member 36 is shaken in response to change in the electric field, whereby toner having a small adhesion force to a carrier is screened out from a developer on the mesh member 36 and the separation effect of excessive toner improves.

Figure 6:
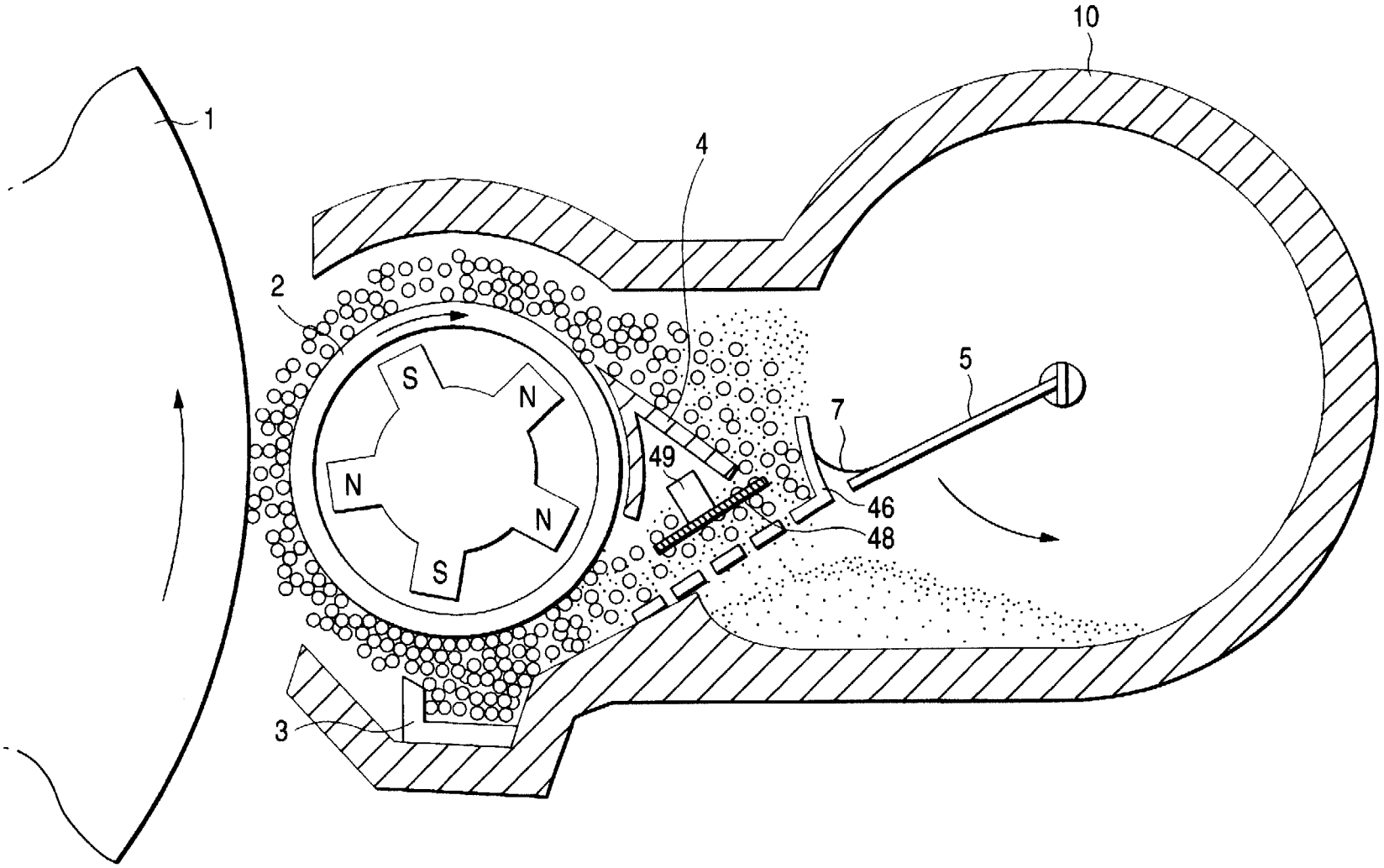
FIG. 6 is a schematic diagram to show the configuration of a developing apparatus of one embodiment of the invention.

FIG. 6 is a schematic diagram to show the configuration of a developing apparatus of one embodiment of the invention.

The developing apparatus comprises a frame 48 opposed to and above a mesh member 46 and a shaking member 49 is attached so as to come in contact with the frame 48. The developing apparatus is the same as that shown in FIG. 1 in other components.

In the developing apparatus, the frame 48 is mechanically shaken by the shaking member 49, shaking a developer above the mesh member 46, whereby redundant toner having a small adhesion force to a carrier in the developer is screened out and passes through the mesh, member 46 for separation. Thus, the separation effect of excessive toner furthermore improves.

Figure 7:
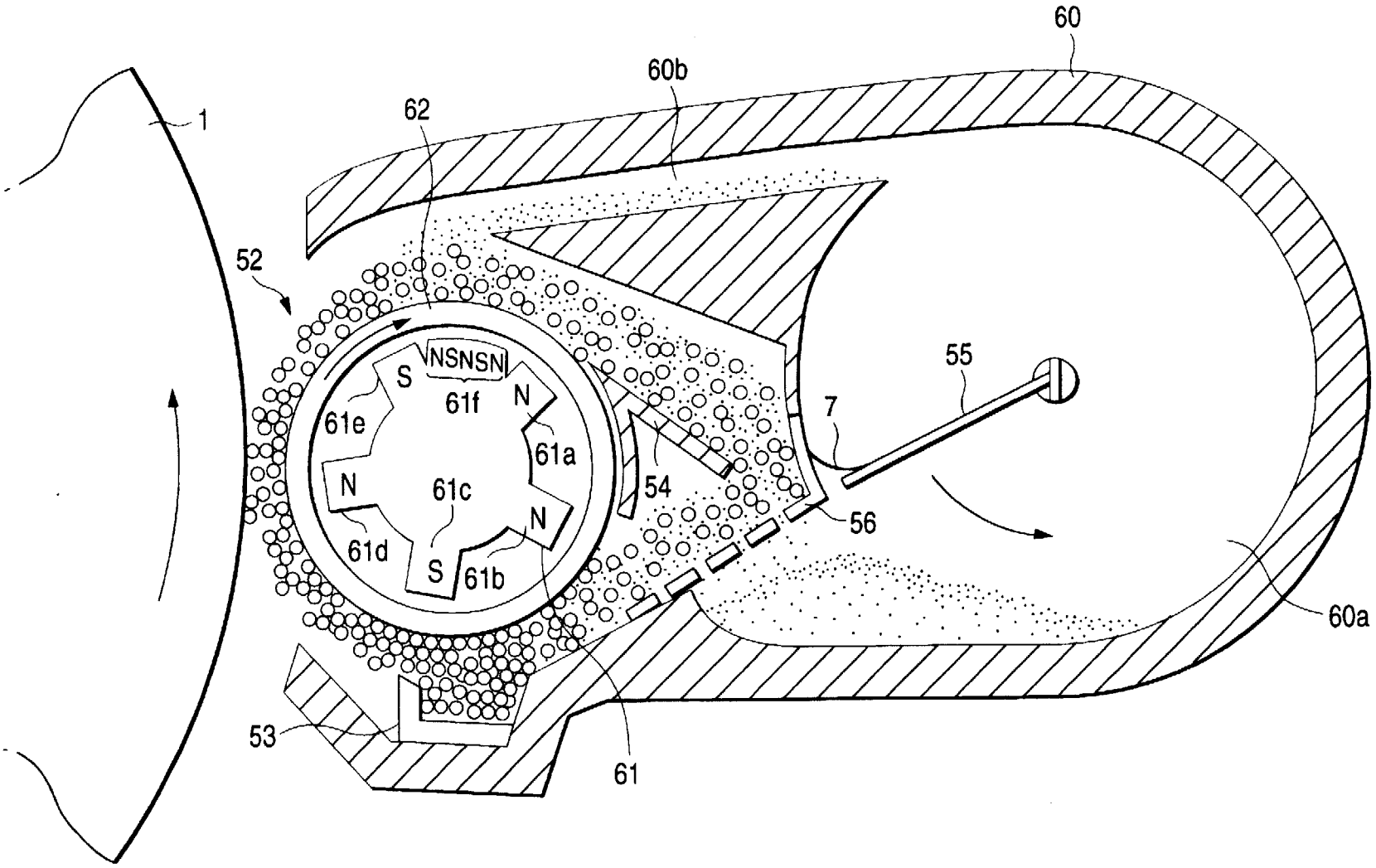
FIG. 7 is a schematic diagram to show the configuration of a developing apparatus of one embodiment of the invention.

FIG. 7 is a schematic diagram to show the configuration of a developing apparatus of one embodiment of the invention.

The developing apparatus comprises a housing 60 containing a developing roll 52 having a magnetic field generation member 61 (magnet roll) having magnetic poles 61*a* and 61*b* magnetized to the same polarity relative to the circumferential direction, magnetic poles 61*c*, 61*d*, and 61*e* for transporting a developer to a developing area, and a developer agitation magnetic pole group 61*f* consisting of an alternating pattern of N and S poles in the circumferential direction in a smaller spacing than other magnetic poles. The neighborhood of the sleeve outer peripheral surface outside the position of the developer agitation magnetic pole group 61*f* provides a toner excess supplying member. Toner dipped up by a paddle 55 from a toner storage section 60*a* passes through a transport passage 60*b* and is supplied to the toner excess supplying member.

The developing apparatus is the same as that shown in FIG. 1 in other components of developer regulation member 53, guide plate 54, paddle 55, mesh member 56, sleeve 62 of the developing roll, etc.

In the developing apparatus, an excess of toner in the toner excess supplying member is supplied to the top of a magnetic brush of a developer with an ear of magnetic carriers and as the sleeve 62 rotates, the magnetic brush is transported in the circumferential direction. At this time, the magnetic brush tumbles in the direction of the magnetic force line of the developer agitation magnetic pole group 61*f* formed on the sleeve 62, and rotation of the magnetic brush by which the upper developer portion moves to the lower part and the lower developer portion moves to the upper part, or so-called tumbling occurs, whereby excessive toner supplied to the upper portion of the developer is sufficiently taken into the developer inside and agitated for making a uniform toner distribution, and friction of toner and carrier causes charging.

Then, the developer is stripped off from the developing roll 52 by a repulsion magnetic field of the magnetic poles of the same polarity, 61*a* and 61*b*, disposed in the magnetic field generation member 61, and is moved along the guide plate 54 to the mesh member 56. Since the magnetic force of the magnetic generation member 61 little acts on the guide plate 54 and the mesh member 56, magnetic carriers can move comparatively freely and almost all area of the magnetic carrier surface comes in contact with toner; charged toner can be attracted on almost all the magnetic carrier face. Further, when the developer slips down along the slope of the mesh member 56 by gravitation, redundant toner having a small charge amount in the developer is shaken off, resulting in the toner density matching the carrier charge capability. The developer is again supplied to the developing roll 52 and is transported to the developing area by circumferential rotation of the sleeve 62 for developing a latent image.

The developing apparatus, which agitates the developer to which excessive toner is supplied by tumbling as described above, can supply toner into the developer more uniformly.

Figure 8:
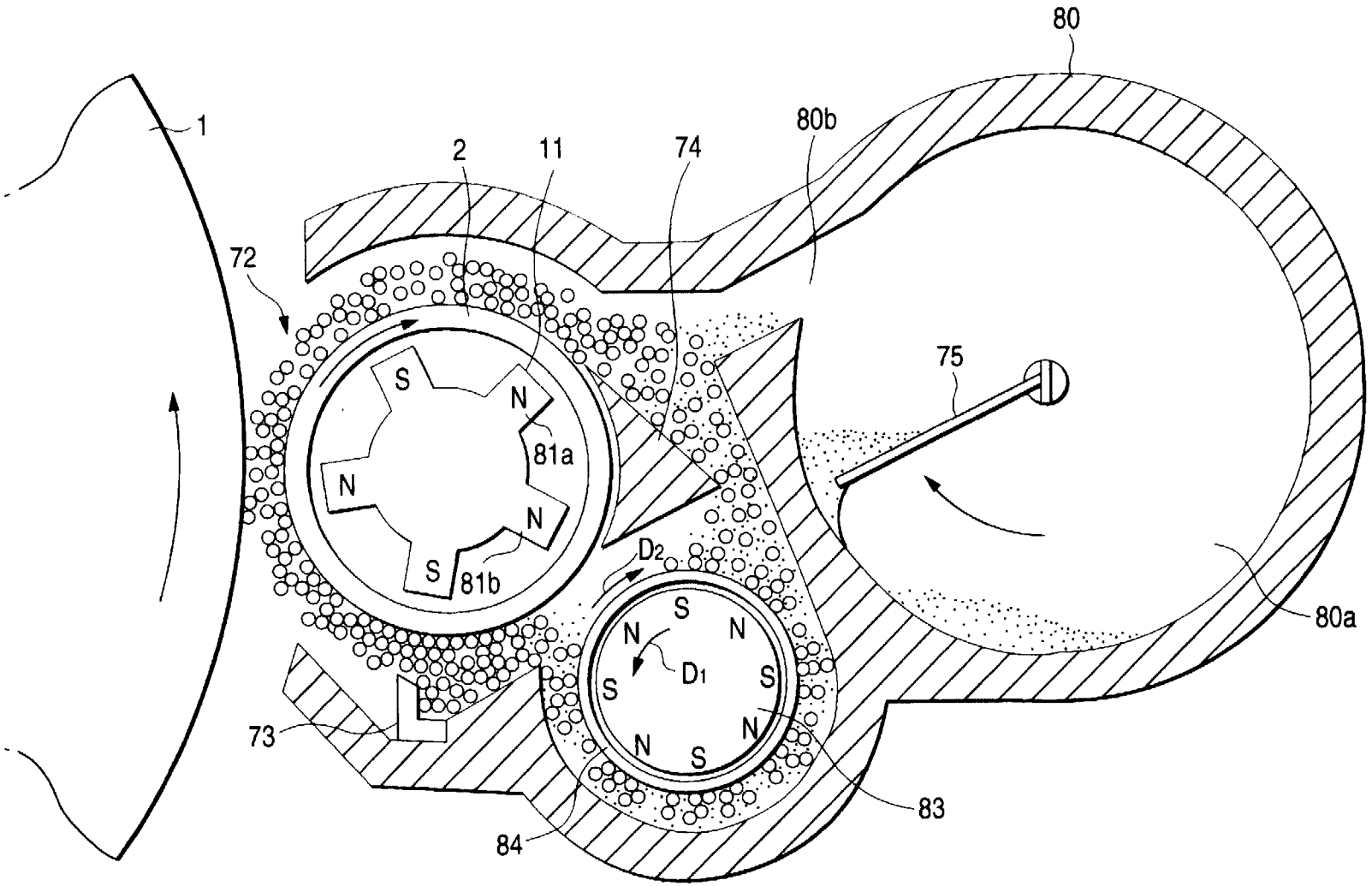
FIG. 8 is a schematic diagram to show the configuration of a developing apparatus of one embodiment of the invention.

FIG. 8 is a schematic diagram to show the configuration of a developing apparatus of one embodiment of the invention.

The developing apparatus uses excessive toner separation means comprising an excessive toner separation magnet roll 83 rotated axially in a housing 80 and an excessive toner separation sleeve 84 fixedly supported outside the magnet roll 83.

The excessive toner separation magnet roll 83 is a cylindrical magnet consisting of an alternating pattern of S and N poles magnetized in the circumferential direction and is rotated in the direction of arrow D1 shown in FIG. 8. The excessive toner separation sleeve 84 is a fixedly supported cylindrical member made of a nonmagnetic material. A developer is transported in the direction of arrow D2 along the outer peripheral surface of the excessive toner separation sleeve 84 by rotation of a magnetic brush as an ear produced by change in a magnetic field generated by rotation of the excessive toner separation magnet roll 83, or so-called tumbling.

The components of the developing apparatus, such as a developing roll 72, a developer regulation member 73, and a guide plate 74, are identical with those of the developing apparatus shown in FIG. 1.

A paddle 75 disposed in a toner storage section 80*a* has the same structure as the paddle of the developing apparatus shown in FIG. 1; it is rotated in an opposite direction for dipping up toner and supplying the toner through an opening 80*b* made in the upper part of the toner storage section 80*a*.

In the developing apparatus, a developer passing through a developing area has toner consumed, is stripped off from the developing roll 72 by a repulsion magnetic field formed by magnetic poles magnetized to the same polarity, 81*a* and 81*b*, and slips down along the guide plate 74. An excess of toner is supplied to the developer from the toner storage section 80*a*.

The developer with excessive toner is magnetically attracted on the excessive toner separation sleeve 84 and is transported along the outer peripheral surface of the excessive toner separation sleeve 84 by change in a magnetic field generated by rotation of the excessive toner separation magnet roll 83. At this time, the developer on the excessive toner separation sleeve 84 is agitated by tumbling a magnetic brush of developer as an ear and excessive toner having a small adhesion force to a carrier in the developer is screened out.

Thus, the excessive toner in the developer is separated and the developer set to the toner density matching the carrier charge capability is supplied to the developing roll 72. Resultantly, the charge amount of toner transported to the developing area becomes almost constant, providing an image stable in density.

In the embodiment, the excessive toner separation magnet roll 83 is rotated and the excessive toner separation sleeve 84 is fixed, but the former may be fixed and the latter may be rotated. Alternatively, they may be rotated in the same direction or opposite directions with a speed difference therebetween.

Figure 9:
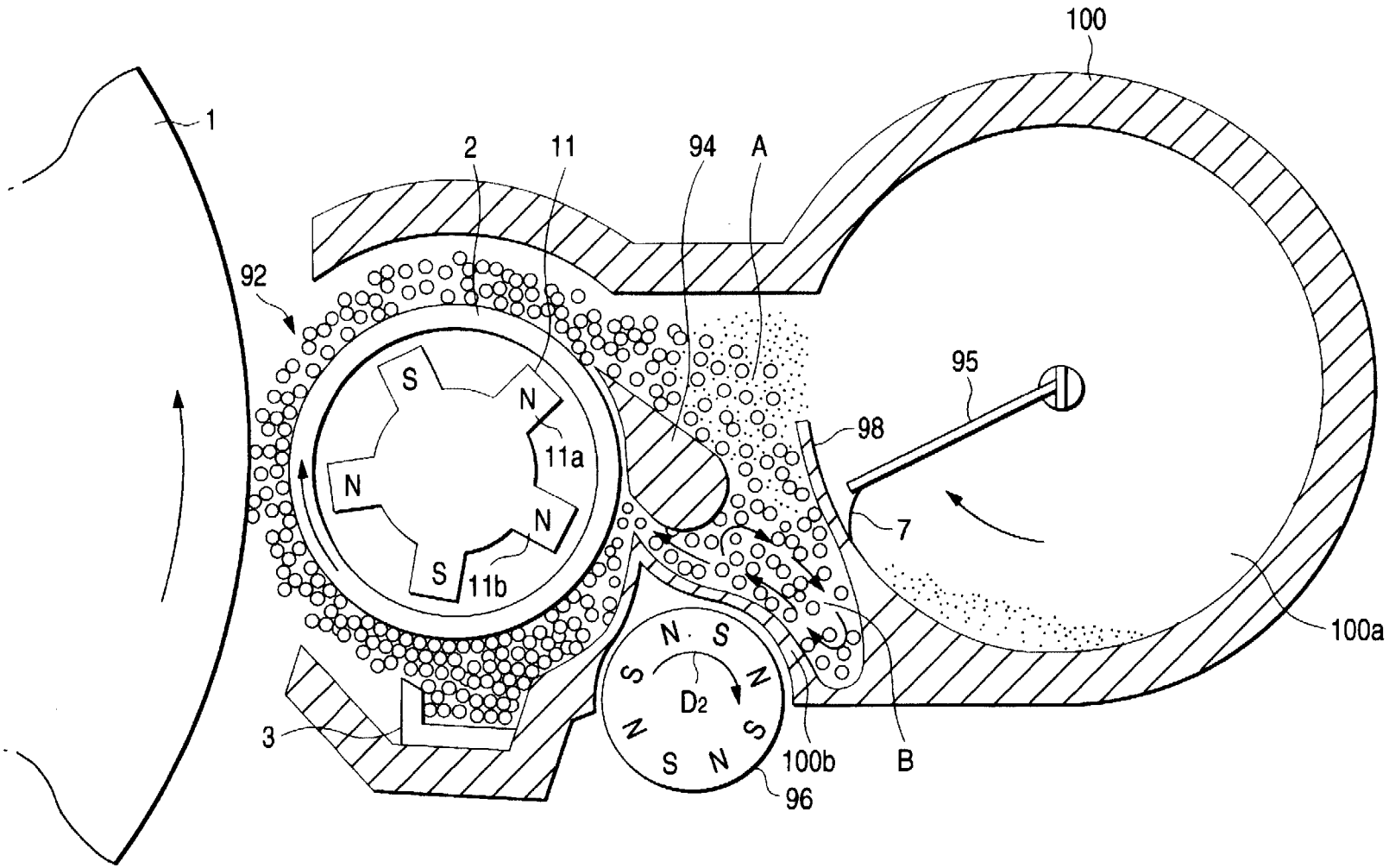
FIG. 9 is a schematic diagram to show the configuration of a developing apparatus of one embodiment of the invention.

FIG. 9 is a schematic diagram to show the configuration of a developing apparatus of one embodiment of the invention.

The developing apparatus has a magnetic roll 96 supported for rotation behind a wall face 100*b* of a housing for storing a developer as excessive toner separation means. On the other hand, the housing 100 is formed with a developer agitation storage section B separated from a toner storage section 100*a* by a partition 98, and a guide member 94 for transporting a developer stripped off from a developing roll 92 after development to the developer agitation storage section B is disposed above the developer agitation storage section B.

Figure 10A:
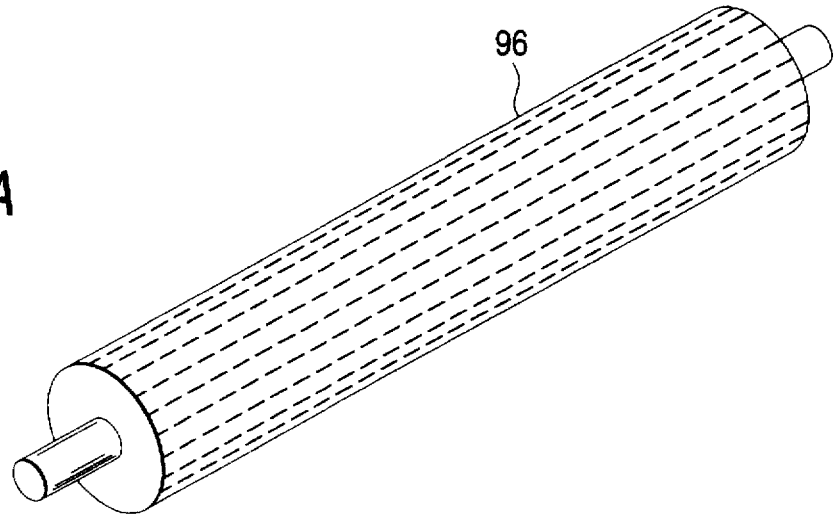
FIGS. 10A to 10C are perspective views to show magnetic pole arrangements of magnet rolls used with the developing apparatus shown in FIG. 9.

The magnet roll 96 is a roll member consisting of an alternating pattern of S and N poles magnetized along the peripheral surface, as shown in FIG. 10A; magnetic poles having a strength of about 0.04 T are magnetized at intervals of about 3 mm. The magnetic roll 96 is rotated in the direction of arrow D2 shown in FIG. 9, thereby generating a changing magnetic field in the developer agitation storage section B. The peripheral speed of the magnetic roll 96 is determined appropriately between 0.1 and 20 as a ratio between the peripheral speeds of the magnetic roll 96 and the development roll 92; it is set to about three times the peripheral speed of the development roll 92.

The guide member 94 is placed near between a developer supplying member and a stripping-off member of the developing roll 92 and is coated on the peripheral surface with a carrier coat agent, etc., along which a developer stripped off from the developing roll 92 slips down. Position A at which the developer slips down provides a toner excess supplying member where an excessive amount of toner is supplied across the partition 98 from the toner storage section 100. This supply method is to supply toner as much as consumed by providing a constant wide space for toner.

The developing roll 92 contains a magnetic field generation member 101 comprising a plurality of magnetic poles like the developing roll 2 shown in FIG. 1. The magnetic poles have a strength of 0.08 T, 0.06 T, 0.07 T, 0.07 T, and 0.06 T in the rotation direction of a sleeve 102 from magnetic pole 101*a* respectively.

The developing apparatus is the same as that shown in FIG. 1 in other components.

In the development apparatus, a developer stripped off from the developing roll 92 after development slips down along the guide member 94 and an excess of toner is supplied by rotation of a paddle 95, then is guided by gravitation into the developer agitation storage section B where a changing magnetic field is formed by rotation of the magnetic roll 96. The developer is transported along the curved face of the wall face 100*b* by the action of the magnetic field and circulates as indicated by the arrow shown in FIG. 9. As the developer circulates, it is agitated and toner comes in contact with carrier and is charged. At this time, the developer is agitated by the action of the magnetic field in a state in which the toner density is raised. Thus, developer stress lessens in comparison with agitation of the developer by mechanical means. That is, when the developer is agitated by the action of the magnetic field, an ear of carrier is set and the carrier itself forms an agitation member at one moment and at the next moment, the ear of the carrier is released and the surface area of the carrier in creases. The carrier and toner are scrubbed with each other reasonably by repeating the state, and easy charging is enabled under low stress in comparison with the case where a mechanical force is exerted on the carrier and toner so that they are scrubbed with each other for contact charging.

The developer thus agitated circulates in the arrow direction and is pulled up. Also, it is attracted by the magnetic pole 101*b* of the developing roll 92. At this time, excessive toner having a small adhesion force to the carrier is screened out by collision resulting from agitation of the developer and by the gravity imposed on the developer, whereby the excessive toner in the developer is separated and the developer having the toner density matching the carrier charge capability is supplied to the developing roll 92. Thus, the charge amount of toner transported to the developing area becomes almost constant, providing an image stable in density.

Figure 10B:
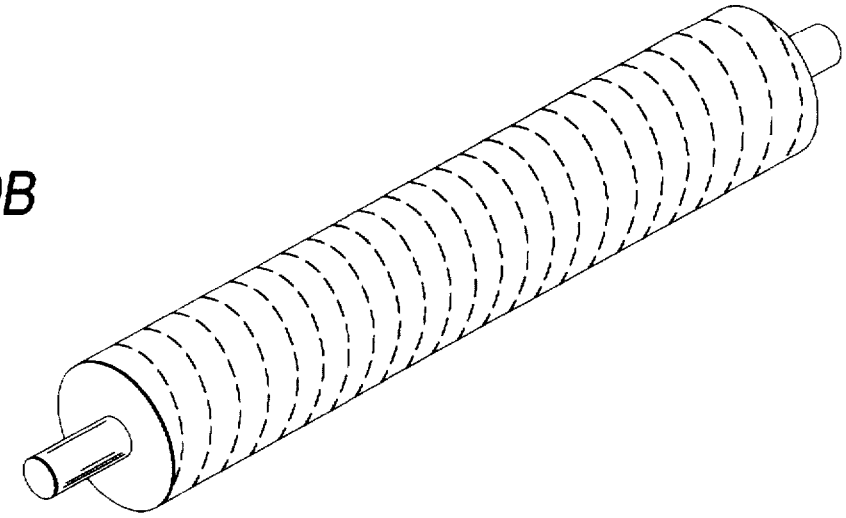
Figure 10C:
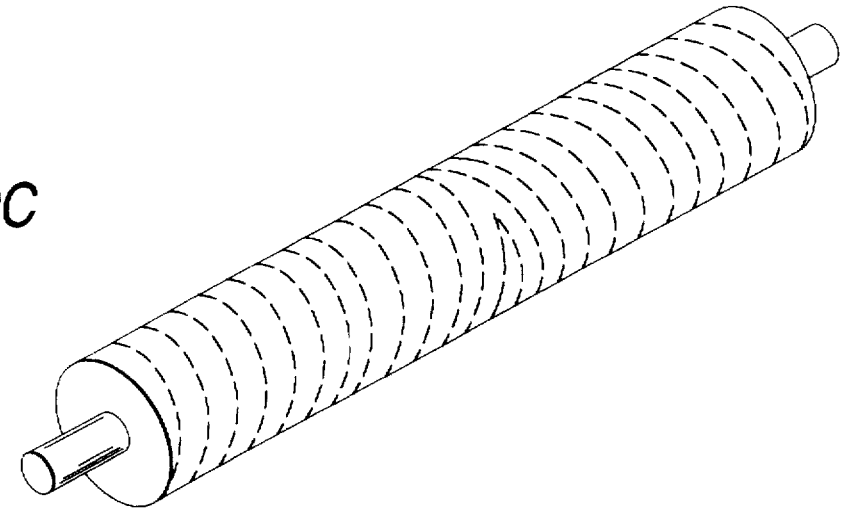

The developing apparatus uses the magnet roll 96 consisting of an alternating pattern of S and N poles magnetized along the peripheral surface, as shown in FIG. 10A. Instead, it may use a magnet roll with S and N poles alternately magnetized in a spiral fashion along the circumferential direction, as shown in FIG. 10B. Further, the developing apparatus may use a magnet roll with S and N poles alternately magnetized in a spiral fashion substantially symmetrical from the neighborhood of the center, as shown in FIG. 10C. As such a magnet roll rotates, a changing magnetic field can be formed in the developer agitation storage section B and the developer can be well agitated and circulated.

Figure 11:
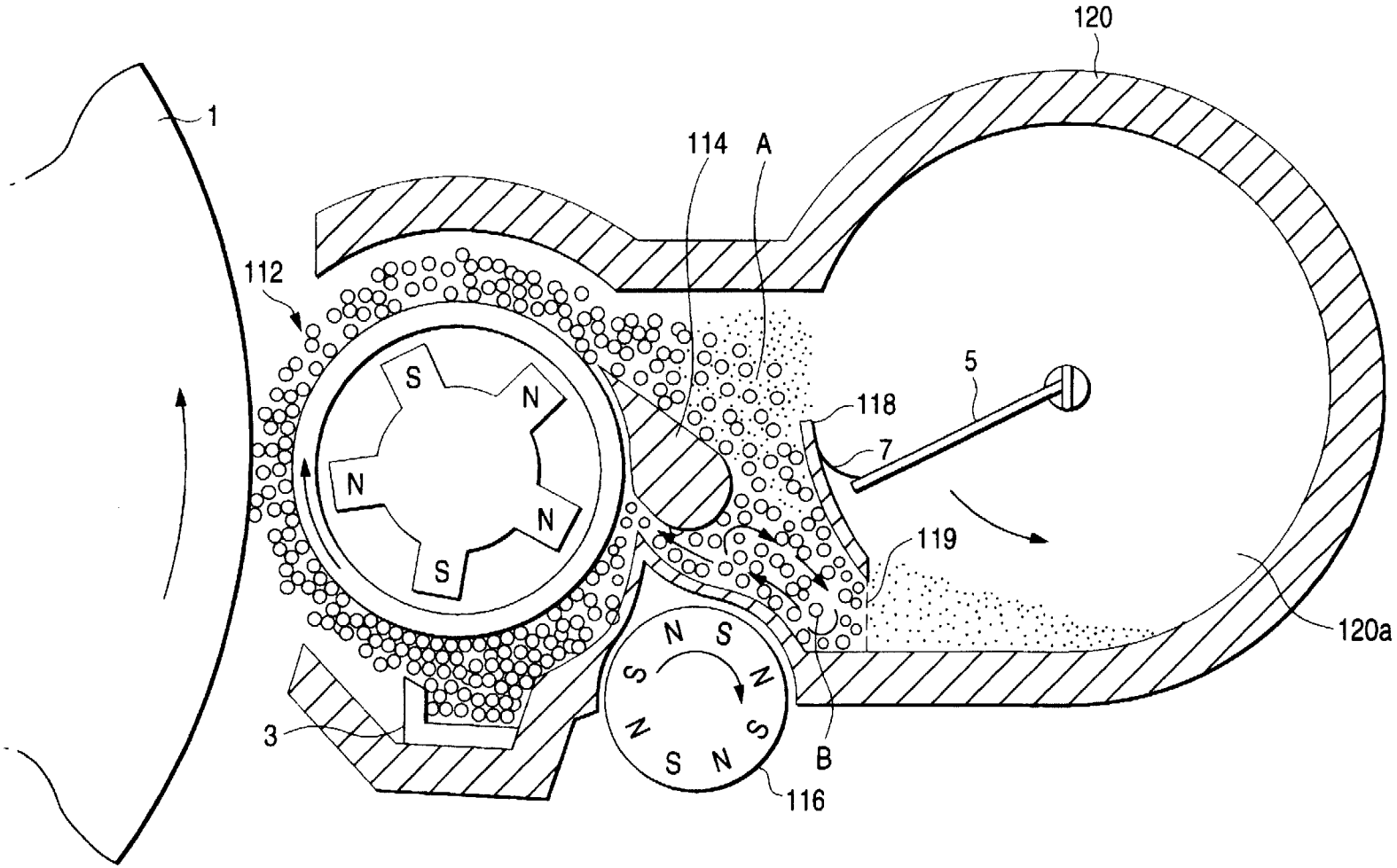
FIG. 11 is a schematic diagram to show the configuration of a developing apparatus of another embodiment of the invention.

FIG. 11 is a schematic diagram to show the configuration of a developing apparatus of another embodiment of the invention.

The developing apparatus comprises a mesh member 119 disposed below a partition 118 in housing 120 between a toner storage section 120*a* and a developer agitation storage section B in addition to the members of the developing apparatus shown in FIG. 9.

The mesh member 119 has a large number of openings of the size for blocking a carrier and allowing toner to pass therethrough; in the embodiment, each opening is set to the size of about 30 μm because the carrier diameter is 50 μm and the toner diameter is 7 μm. Any desired material can be selected for the mesh member 119; preferably the mesh member 119 is coated with fluororesin, a carrier coat agent, etc., like a guide member 114.

The developing apparatus is the same as that shown in FIG. 9 in other components.

In the developing apparatus, excessive toner separated when a developer is agitated and circulated in the developer agitation storage section B passes through the openings of the mesh member 119 and is recovered to a toner storage section 120*a*. Thus, toner separated by the operation of a magnet roll 116 can be transported to a toner excess supplying member; toner can be again supplied smoothly. The developing apparatus can supply a developer stable in toner density to a developing roll 112 even when a comparatively small amount of magnetic carrier (about 100 g or less) is contained.

To prevent the mesh member 119 from being clogged, the mesh member 119 may be shaken as it comes in contact with a film member attached to the tip of a paddle.

Figure 12:
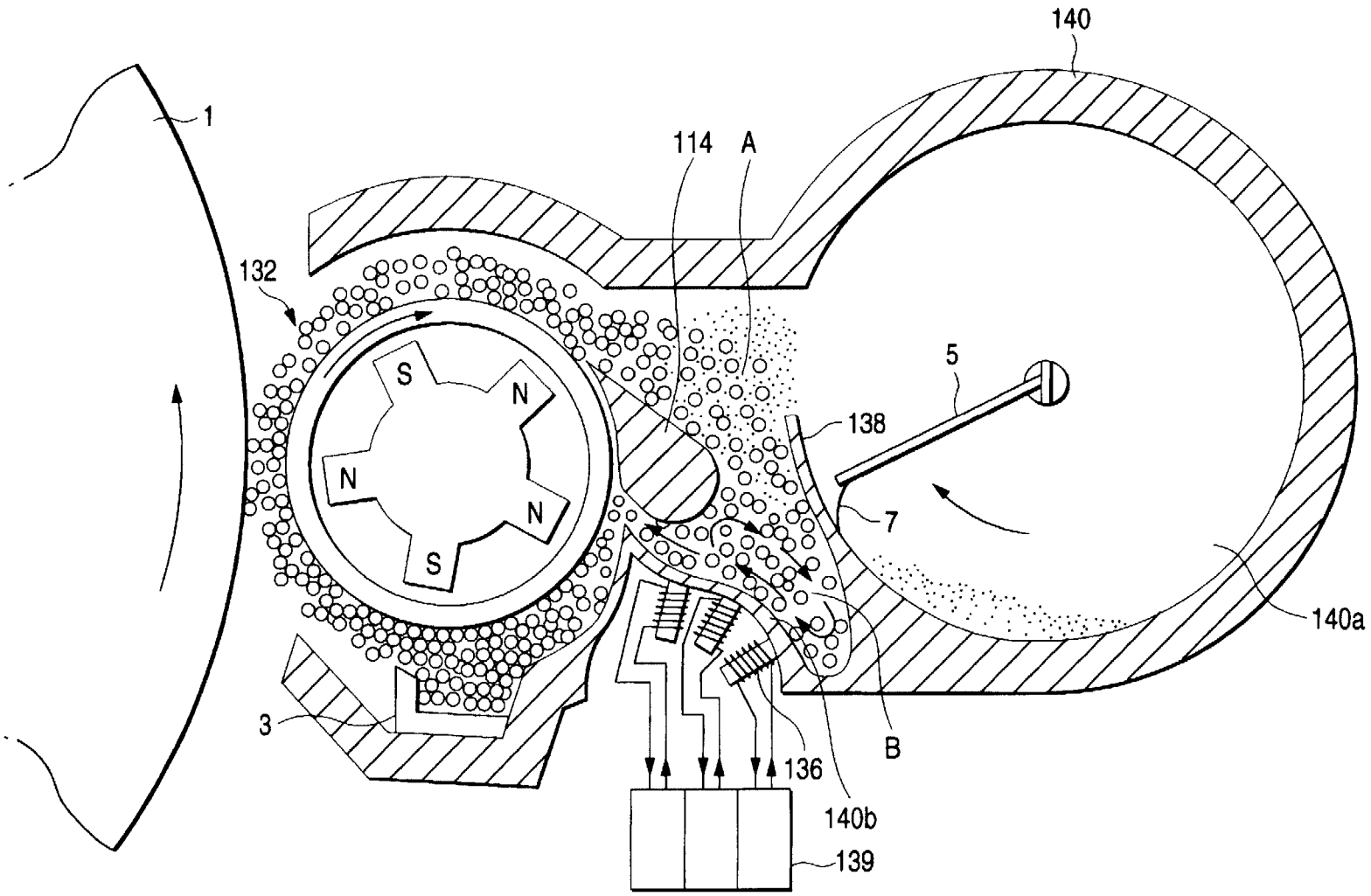
FIG. 12 is a schematic diagram to show the configuration of a developing apparatus of one embodiment of the invention.

FIG. 12 is a schematic diagram to show the configuration of a developing apparatus of one embodiment of the invention.

The developing apparatus comprises a plurality of electromagnets 136 arranged along a wall face 140*b* of a housing 140 and a power supply unit 139 for controlling a current direction and timing for energizing the electromagnets 136 in place of the magnet roll 96 of the developing apparatus shown in FIG. 9. Wall face 140*b* is separated from a toner storage section 140*a* by a partition 138.

The electromagnets 136 are connected to the power supply unit 139 in parallel and are controlled so as to generate alternating fields with phase differences when they are energized. The developing apparatus is the same as that shown in FIG. 9 in other components.

In the developing apparatus, a developer in the developer agitation storage section B is transported along the wall face 140*b* as in the developing apparatus shown in FIG. 9 by alternating fields generated by the electromagnets 136 and is circulated in the arrow direction shown in FIG. 12, whereby toner is charged and toner having a small adhesion force to carrier is separated and the developer having the toner density matching the carrier charge capability is supplied to a developing roll 132.

In the developing apparatus according to the invention of aspect 10, magnetic field generation means can be set appropriately if it generates magnetic field for transporting and circulating the developer in the developer agitation storage section B. In addition to the magnet roll used with the developing apparatus shown in FIG. 10 or 11 or the electromagnets used with the developing apparatus shown in FIG. 12, an endless belt with an alternating pattern of S and N poles magnetized may be circumferentially rotated by driving a support roll.

Figure 13:
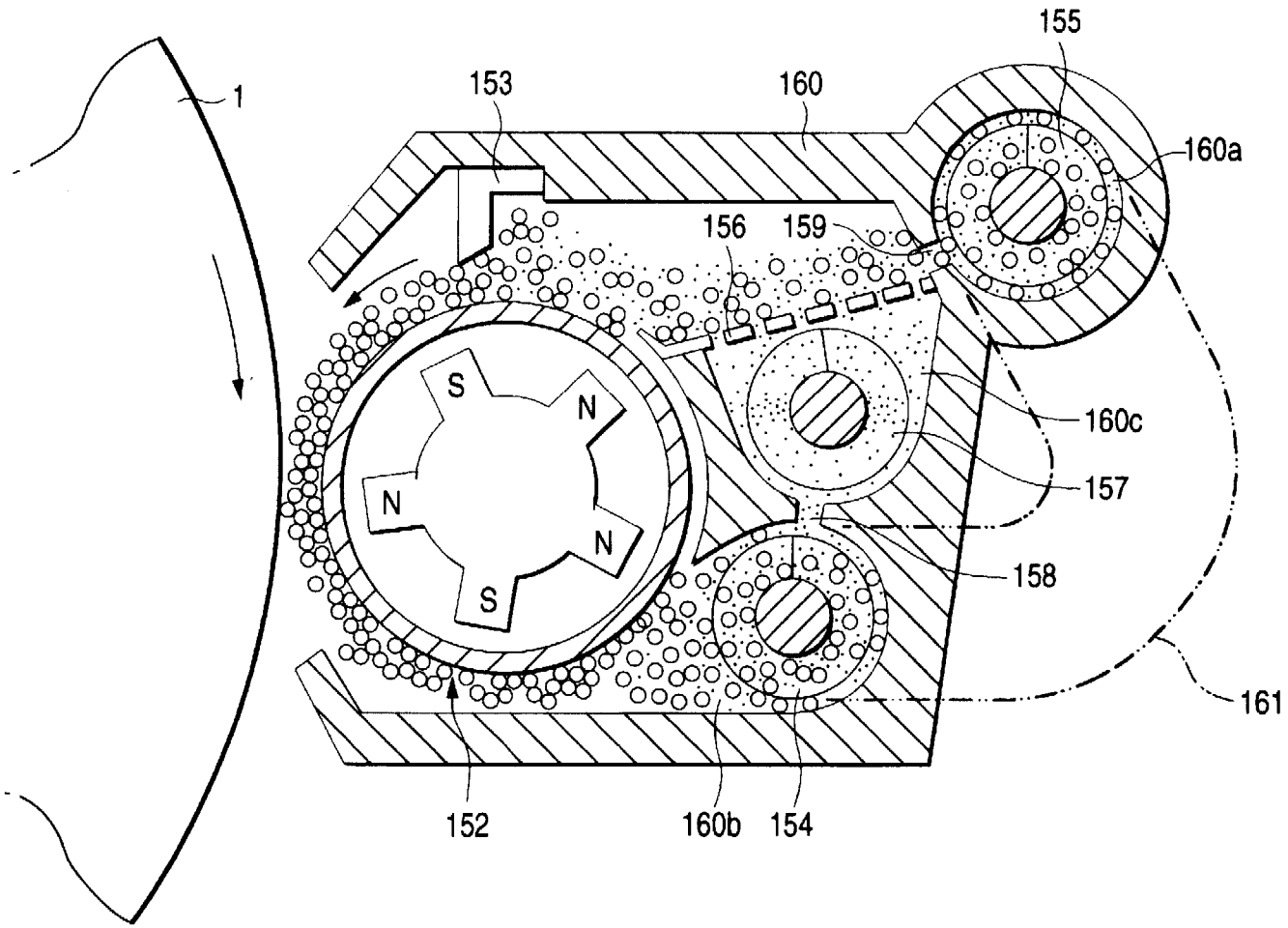
FIG. 13 is a schematic diagram to show the configuration of a developing apparatus of one embodiment of the invention.

FIG. 13 is a schematic diagram to show the configuration of a developing apparatus of one embodiment of the invention.

The developing apparatus is opposite to the developing apparatus shown in FIG. 1 in rotation direction of developing roll 152 and comprises a developer recovery mix chamber 160*b* to which a developer passing through a developing area is recovered, at a position facing the lower part of the developing roll 152. A toner storage chamber 160*c* where toner passing through a mesh member 156 drops is disposed above the developer recovery mix chamber 160*b*, and a slit opening 158 is made in a partition between the toner storage chamber 160*c* and the developer recovery mix chamber 160*b*. The developer recovery mix chamber 160*b* and the toner storage chamber 160*c* are provided with augers 154 and 157 respectively for agitating and transporting the contents. A developer supply chamber 160*a* for supplying a developer to the top of the mesh member 156 is disposed in the upper part of a housing 160, as is regulation member 153, and contains a spiral auger 155 for supplying a developer through an slit 159. Further, a developer passage 161 for transporting a developer to the developer supply chamber 160*a* is coupled to the axial end of the developer recovery mix chamber 160*b*.

Figure 14:
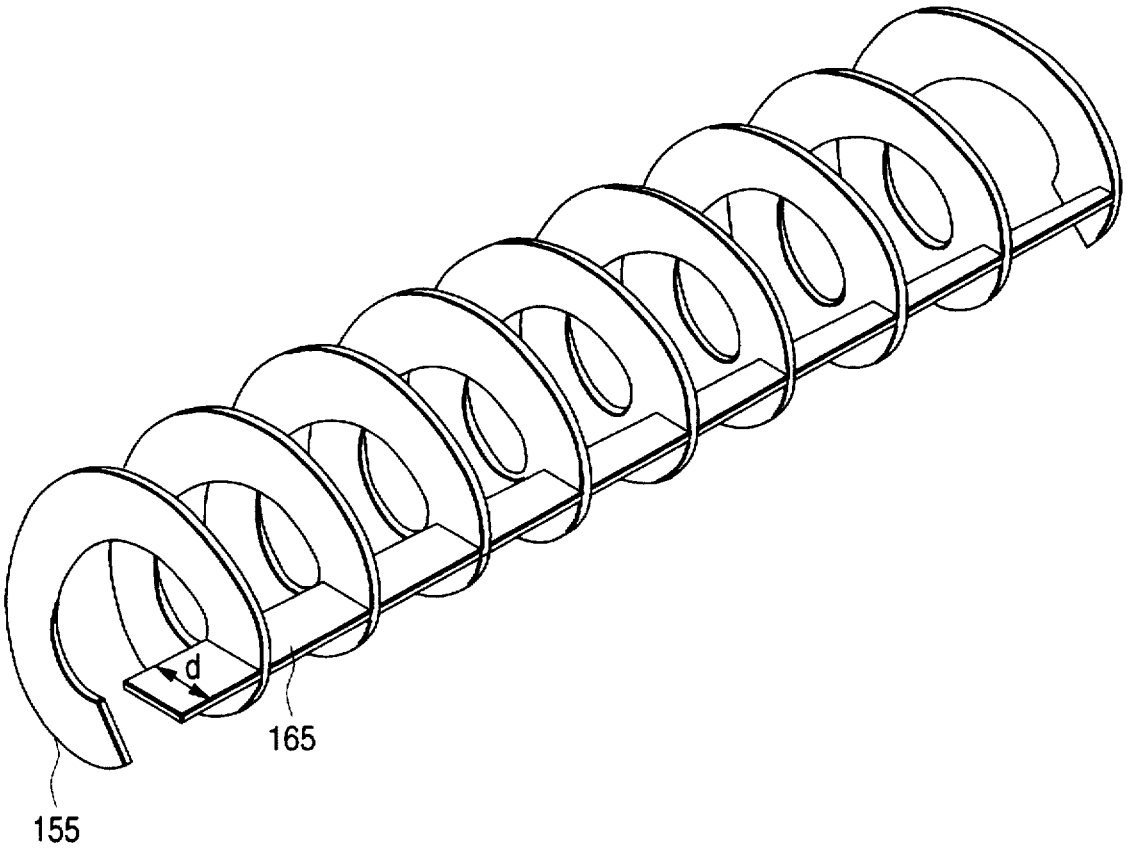
FIG. 14 is a perspective view to show a spiral auger used with the developing apparatus shown in FIG. 13.
Figure 15:
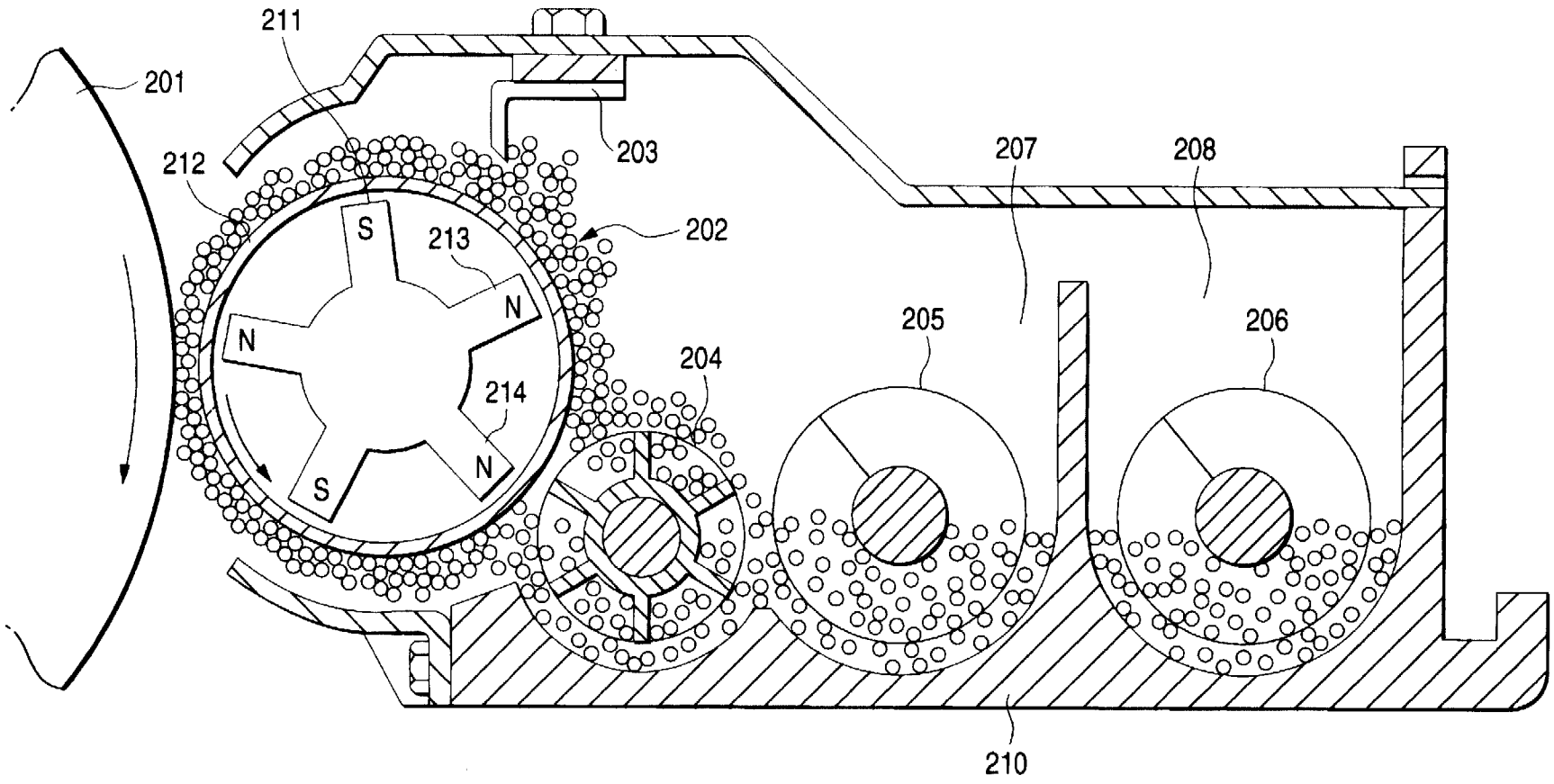
FIG. 15 PRIOR ART
FIG. 15 is a schematic diagram to show the configuration of a conventional developing apparatus.
Figure 16:
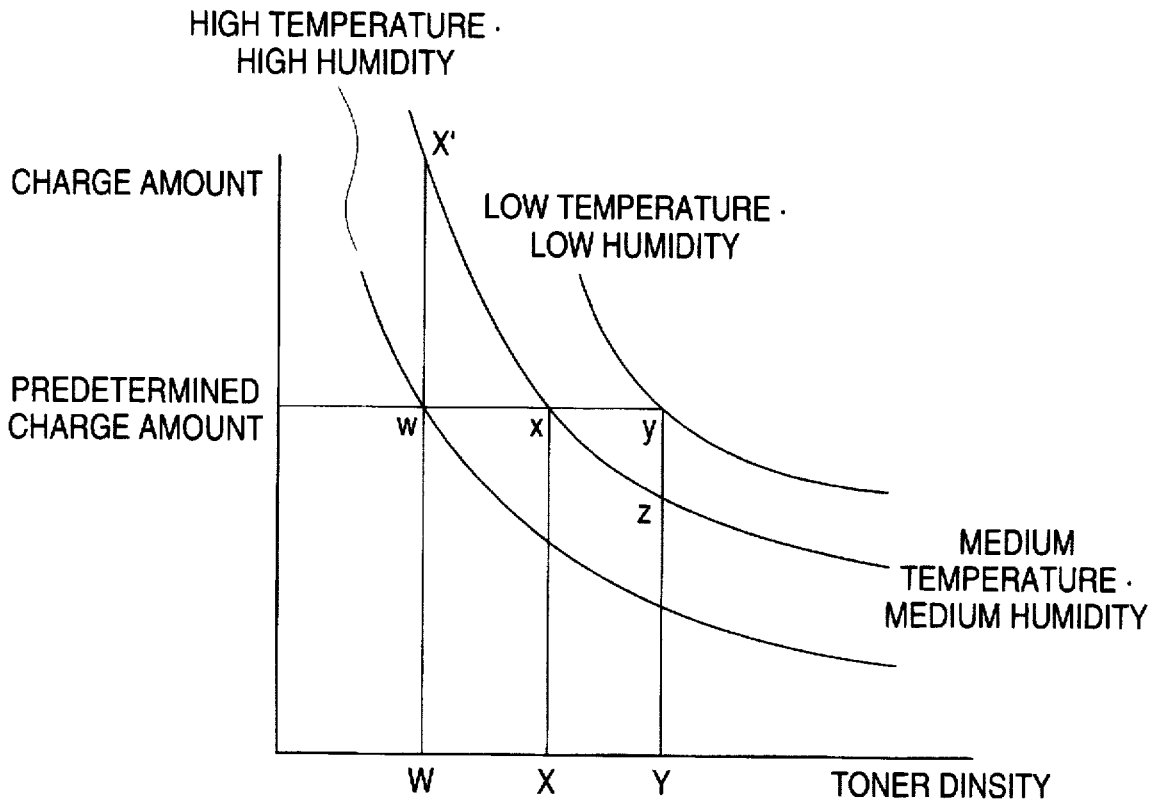
FIG. 16 PRIOR ART
FIG. 16 is a graph to show the relationship between the toner density and toner charge amount in the conventional developing apparatus.

The spiral auger 155 comprises a coupling plate 165 for coupling spiral elements as shown in FIG. 14 and the width of the coupling plate 165, d, is set so as to widen gradually in the developer transport direction.

The developing apparatus is the same as that shown in FIG. 1 in other components.

In the developing apparatus, the developer after development is stripped off by the action of repulsion magnetic poles of the developing roll 152 and is transported axially by the auger 154 in the developer recovery mix chamber 160*b*. An excess of new toner is supplied from the toner storage chamber 160*c* and is agitated together with a recovered developer. The resultant developer is transported on a developer transport passage 161 to the developer supply chamber 160*a*. In the toner storage chamber 160*c*, toner recovered through the mesh member 156 is replenished with new toner from a toner box (not shown). The resultant toner is supplied to the developer recovery mix chamber 160*b* as new toner.

On the other hand, the developer transported to the developer supply chamber 160*a* is transported axially by the spiral auger 155. At this time, by translational motion by rotation of the spiral auger 155 and the action of the coupling plate 165, the developer is combed up in a direction perpendicular to the translational motion direction and is swept out through the slit 159. At the time, the coupling plate 165 has a width gradually widening in the developer transport direction and the sweep-out amount and the transport amount of the translational motion are well balanced, so that an almost equal amount of developer is supplied through the slit 159 to the top of the mesh member 156.

The developer fed onto the mesh member 156 is a developer mixed with an excess of toner, and slips down along the slope of the mesh member 156 by gravitation. At this time, redundant toner having a small adhesion force to carrier drops through the mesh member into the toner storage chamber 160c, whereby the developer on the mesh member 156 is adjusted to the toner density matching the carrier charge capability.

On the other hand, the redundant toner screened out into the toner storage chamber 160c is agitated together with fresh toner transported from the toner box (not shown) by the auger 157 and the resultant toner is supplied excessively to a recovered developer as supply toner through the opening 158. The supply timing of the fresh toner is set by using known means, such as pixel count or solid batch sense.

Although the width of the coupling plate 165 of the spiral auger 155 is set to axially different dimensions in the developing apparatus, the width of the coupling plate 165 may be made uniform and the slit for supplying a developer may be formed so as to widen gradually toward the developer transport direction. That is, the amount of the developer being transported by the spiral auger decreases as the developer goes downstream in the transport direction, but the slit is widened in the developer transport direction, whereby toner is easily discharged gradually and an almost equal amount of developer in the transport direction flows out.

As we have discussed, the developing apparatus according to the invention supplies an excess of toner to a developer, then screens out toner having a small adhesion force to magnetic carrier for supply to the developer transport member, so that the toner density and charge amount of the developer transported to the developing area can be maintained almost uniform and a stable image density can be provided over a long term. Complicated toner density control means as used formerly is not required, decreasing costs and downsizing the apparatus. The invention can also be applied to a developing apparatus storing a comparatively small amount of developer. If the invention is applied to color image formation, stable and good developing can also be executed.

What is claimed is:

1. A developing apparatus using a dual-component developer containing a magnetic carrier and toner electrically attracted to the magnetic carrier for selectively transferring the toner to an electrostatic latent image formed on an image support for visualizing the latent image, said developing apparatus comprising:

a developer transport member adapted to face the image support, having a rotatable peripheral surface for supporting and transporting the developer;

a toner excess supplying member for containing developer to be supplied to the developer transport member and for supplying an excess of toner to the developer;

excessive toner separation means for separating toner having a small adhesion force to the carrier from the developer to which excessive toner is supplied; and a recirculator for transporting the toner separated from the excessive toner separation means to the toner excess supplying member.

2. The developing apparatus of claim 1, wherein said developer transport member comprises;

a magnetic field generation member having a plurality of magnetic poles along the peripheral surface thereof, and a sleeve making circumferential rotation outside said magnetic field generation member, and wherein said toner excess supplying member is disposed in an area which is not affected by a magnetic carrier attraction force of said magnetic field generation member.

3. The developing apparatus of claim 1, wherein said developer transport member comprises;

a magnetic field generation member having a plurality of magnetic poles along the peripheral surface thereof, and a sleeve making circumferential rotation outside said magnetic field generation member, wherein said toner excess supplying member is disposed at a position along an outer peripheral surface of said sleeve, and wherein a plurality of magnetic poles are disposed in a circumferential direction in a portion of said magnetic field generation member facing said toner excess supplying member as an alternating pattern of N and S poles.

4. The developing apparatus of claim 1, wherein said excessive toner separation means comprises;

a sieve member provided with a large number of openings each of which has a size for blocking the magnetic carrier and allowing toner to pass therethrough so as to screen out excessive toner from the developer.

5. The developing apparatus of claim 4, further comprising:

shaking means for shaking said sieve member.

6. The developing apparatus of claim 5, wherein said shaking means is disposed so as to come in contact with said sieve member for mechanically shaking said sieve member.

7. The developing apparatus of claim 5, wherein said shaking means is an electrode member disposed facing said sieve member, an AC voltage being applied to said electrode member.

8. The developing apparatus of claim 4, further comprising:

a member for shaking the developer on said sieve member.

9. The developing apparatus of claim 1, wherein said excessive toner separation means comprises:

magnetic field generation means with an alternating pattern of N and S poles magnetized along an outer peripheral surface; and a sleeve having a peripheral surface supported for circumferential rotation outside said magnetic field generation means for magnetically attracting the developer on the peripheral surface thereof and transporting the developer.

10. The developing apparatus of claim 1, wherein said excessive toner separation means comprises;

magnetic field generation means for generating a changing magnetic field for agitating, pulling up the developer in said developing apparatus by a magnetic force, and supplying the developer to the peripheral surface of said developer transport member.

11. The developing apparatus of claim 10, wherein said magnetic field generation means is a magnet having a plurality of magnetic poles, and being rotatably supported behind a wall face of a housing for storing the developer.

12. The developing apparatus of claim 11, wherein said magnetic field generation means is a roll member with an alternating pattern of S and N poles magnetized on a peripheral surface thereof.

13. The developing apparatus of claim 10, wherein said magnetic field generation means is a plurality of electromagnets arranged along a wall face of a housing for storing the developer, said developing apparatus further comprising;

a power supply unit for controlling a current direction and timing for energizing said plurality of electromagnets.

14. The developing apparatus of claim 1, wherein the toner excess supplying member comprises a guide plate for directing developer carried by the developer transport member toward the excessive toner separation means.

15. The developing apparatus of claim 1, wherein the recirculator comprises a housing adapted to contain toner separated by the excessive toner separation means, and a member movable within the housing to transport separated toner from the housing to the toner excess supplying member.

16. The developing apparatus of claim 15, wherein the movable member is a rotatable arm disposed within the housing.

17. The developing apparatus of claim 15, wherein the movable member is adapted to contact and shake the excessive toner separation means.

* * * * *